United States Patent [19]

Barber

[11] Patent Number: 4,580,815

[45] Date of Patent: Apr. 8, 1986

[54] COMPOSITE STRIP FOR ADD-ON TAB FOR FILE FOLDER

[75] Inventor: Donald T. Barber, Toronto, Canada

[73] Assignee: Datafile Limited, Willowdale, Canada

[21] Appl. No.: 521,341

[22] Filed: Aug. 8, 1983

Related U.S. Application Data

[63] Continuation-in-part of Ser. No. 276,939, Jun. 24, 1981, Pat. No. 4,523,776.

[51] Int. Cl.[4] ..... B22B 31/10; B42D 15/00

[52] U.S. Cl. ..... 283/81; 40/23 A; 40/360; 156/64

[58] Field of Search ..... 40/5, 23 A, 359, 360; 156/64, 216, 277, 350, 351, 379, 384, 247–248; 283/36, 38, 39, 41, 81, 900

[56] References Cited

U.S. PATENT DOCUMENTS

| | | | |
|---|---|---|---|
| 1,116,383 | 11/1914 | Case | 40/23 A |
| 3,245,162 | 4/1966 | McElroy | 40/23 A |
| 3,691,662 | 9/1972 | Cunningham | 40/23 A |
| 3,747,242 | 7/1973 | Heimann | 40/360 X |
| 3,805,426 | 4/1974 | Cunningham | 40/2 R |
| 4,204,639 | 5/1980 | Barber et al. | 40/23 A X |
| 4,329,191 | 5/1982 | Barber | 283/81 X |

FOREIGN PATENT DOCUMENTS

| | | | |
|---|---|---|---|
| 934261 | 9/1973 | Canada | 283/81 |
| 1289515 | 2/1969 | Fed. Rep. of Germany | 40/23 A |

*Primary Examiner*—Paul A. Bell

[57] ABSTRACT

A composite strip for preparation of a substrate edge for application of labels is disclosed. The composite strip comprises an elongated carrier web having an upper surface and a lower surface with the lower surface having a pressure sensitive adhesive backing covered with a removable release sheet. A high tensile strength film, such as that sold under the trademark "Mylar" by DuPont made of a polyethylene terephthalate, according to the preferred embodiment is directly bonded to the upper surface of the carrier web by a further adhesive. This film provides a receptor surface for receiving labels. The film is of a width equal to or less than the width of the carrier web and of a width to receive a label therein. This composite strip has proven useful in preparing a substrate, such as on existing file folder tab or the edge of an x-ray jacket for the subsequent application of a discrete series of labels applied about the edge of the substrate. Such discrete series of labels may also be applied to the composite strip before its application to the edge of the substrate. It is also possible to apply the labels beneath the high tensile strength film which in this case would be transparent. The composite strip can advantageously be used in combination with a tab extension to provide an add-on assembly.

3 Claims, 23 Drawing Figures

FIG.3.
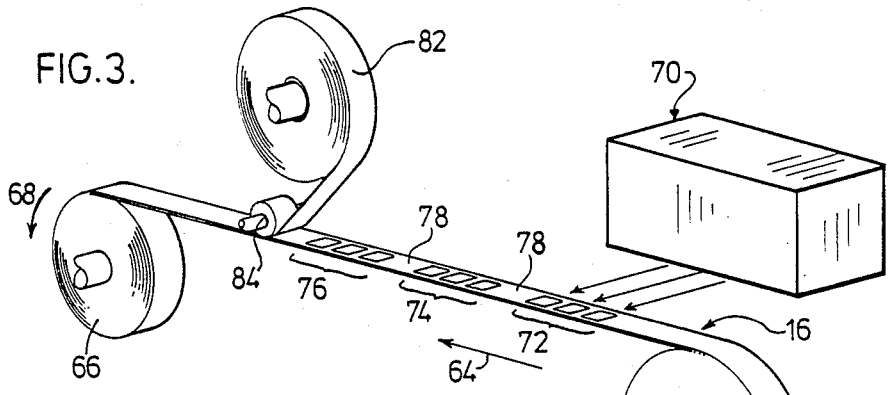
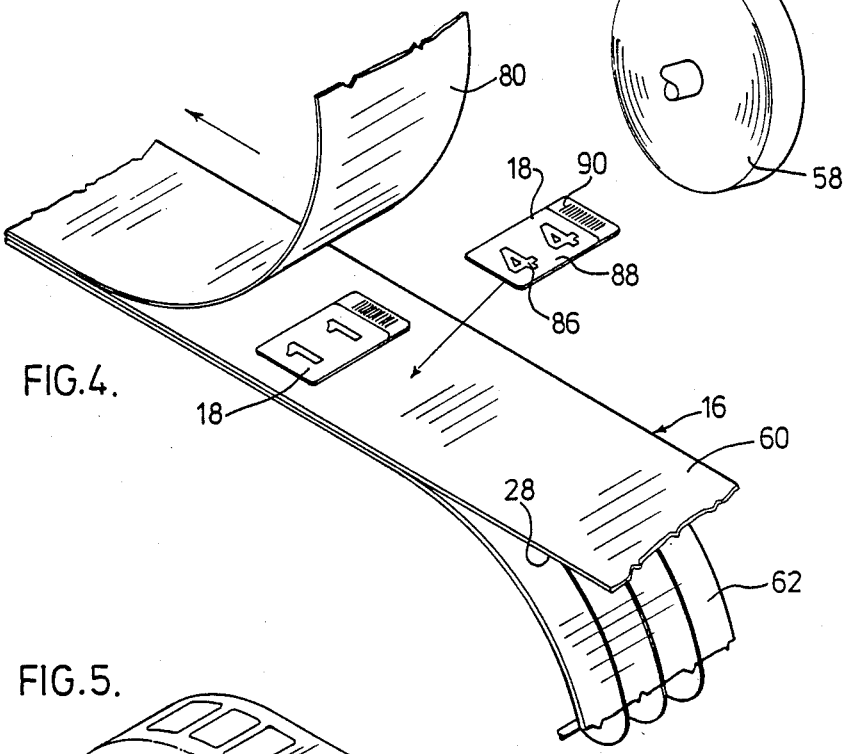
FIG.4.
FIG.5.
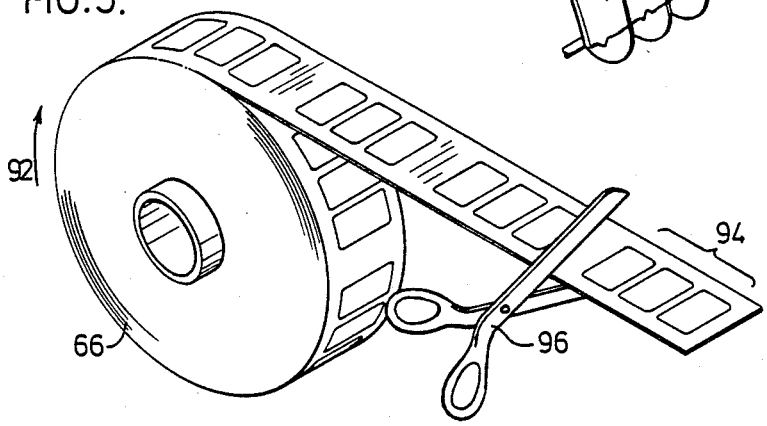

106
28
80
16

42
104
30
14
24
108
110
54
36
10
44
26
50
102
100

112
114
36
14

10
86
34
16
38
18
116

24
26
34
38
16
118
14
36
10

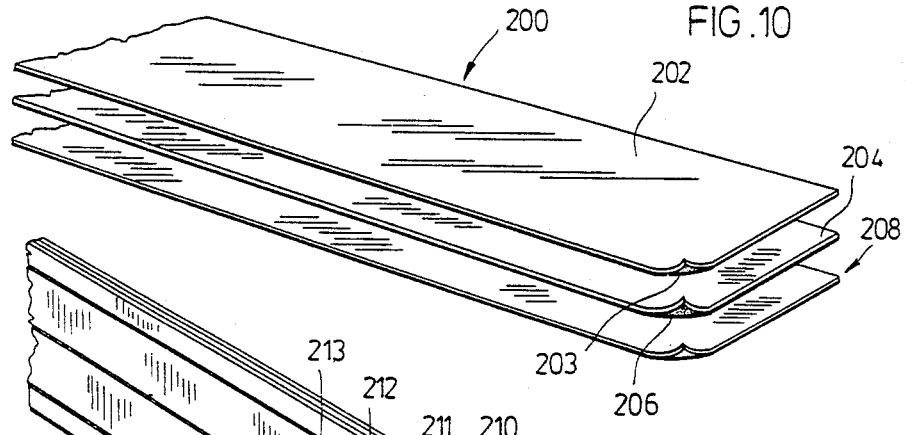
FIG. 10
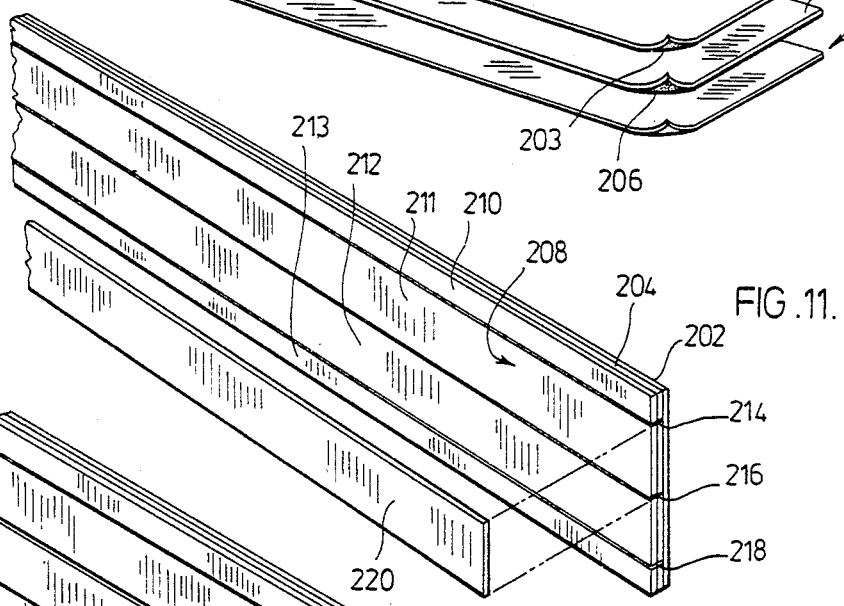
FIG. 11.
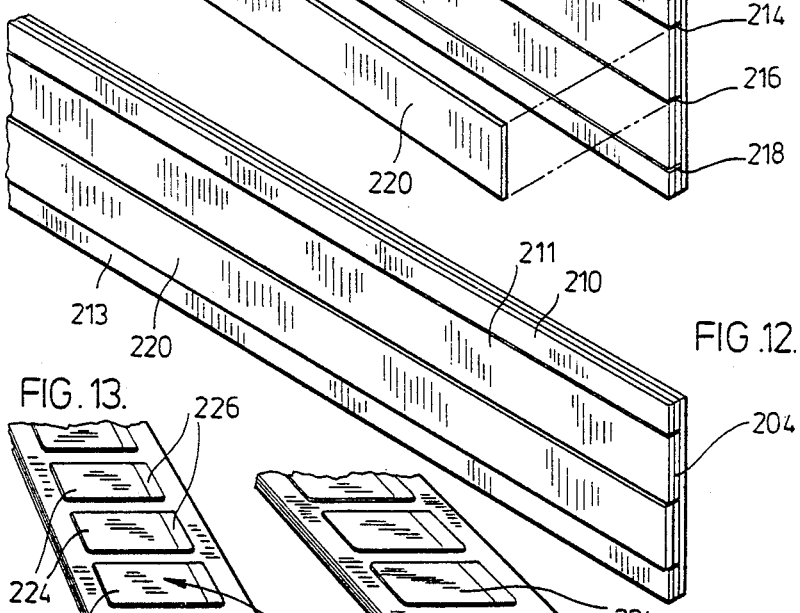
FIG. 12.
FIG. 13.
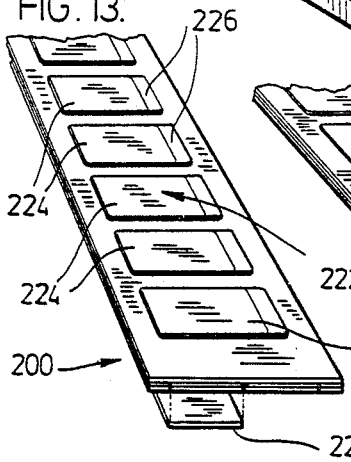
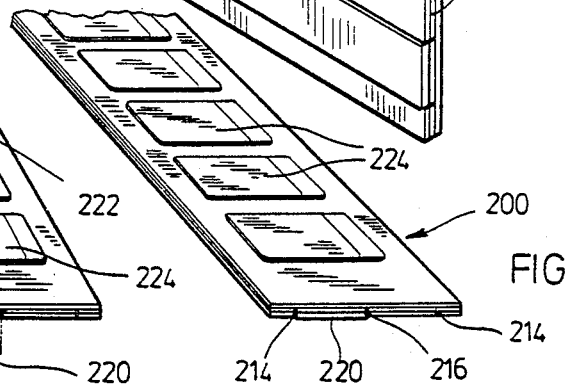
FIG. 14.

COMPOSITE STRIP FOR ADD-ON TAB FOR FILE FOLDER

This is a continuation-in-part application of United States Application Ser. No. 276,939 filed June 24, 1981 now U.S. Pat. No. 4,523,776.

FIELD OF THE INVENTION

This invention relates to a composite strip for use in preparing an edge of a substrate for reception of labels or for attaching labels to such substrate edge and a method of making the composite strip. The composite strip can advantageously be used in combination with a tab extension member for use in adding a tab to a substrate edge.

BACKGROUND OF THE INVENTION

It is common to add a tab to a file edge to provide a new code for the file, a colour coded arrangement for the file or to add machine readable data to a file. There are commercially available simple add-on tabs which permit the application of a code or name to a file folder such as disclosed in Heimann U.S. Pat. No. 3,747,242 or Turner, U.S. Pat. No. 4,201,403. These forms of add-on tabs are servicable; however, they are very flimsy and can add to the thickness of the file folder and in some situations may be readily torn from the file folder.

Another example of a more rigid add-on tab for a file folder is disclosed in Barber et al U.S. Pat. No. 4,204,639. This type of add-on tab, although of somewhat stronger construction than other add-on tabs, substantially increases the thickness of the file folder and may still be ripped from the file folder due to a bending of the tab causing the tab where it abuts the folder edge to separate.

Cunningham Canadian Pat. No. 934,261 discloses an add-on tab for a file folder; however, with that arrangement individual tabs are applied to the folder edge. In a situation where a plurality of labels are required, individual tabs are applied and thus permit relative movement between the tabs resulting in the individual tabs being caught and damaged or torn from the folder edge. The tabs as produced each have the same subject matter thereon so that different rolls of such tabs are required to provide the necessary different types of indicia in forming a new code for a file folder.

It has been discovered that the application of a high tensile strength film directly onto a carrier web and then optionally applying labels to the film provides a product which is useful in preparing an edge of a substrate for reception of labels to designate at least in part a code peculiar to such substrate. Optionally, the composite strip may be used with an extension member to provide an add-on tab assembly for substrates. It is also possible to secure labels beneath the high tensile strength film which would be transparent and apply this combination to a substrate edge with or without a tab extension member. The product of the present invention allows the automatic application of labels directly onto a carrier web which can subsequently be adhered to the edge of a substrate. The labels provide a visible code on the edge of the substrate to allow fast identification of the substrate. Therefore, the system of the present is extremely flexible and can advantageously be used in combination with any of the following:

(1) automatic application of labels, (2) an extension member to provide an add-on tab to a substrate, and (3) to prepare a substrate edge for the manual application of labels in the field.

SUMMARY OF THE INVENTION

According to the present invention a composite strip for preparation of a substrate edge for the application of labels comprises an elongated carrier web having an upper surface and a lower surface with the lower surface having a pressure sensitive adhesive backing covered with a removable protective cover means. A high tensile strength film means is bonded to the upper surface of the carrier web at least adjacent the edges thereof by a further adhesive. The composite strip provides a receptor surface for receiving labels, and the film means is of a width equal to or less than the width of the carrier web with the composite strip being of a width to receive a label therewithin.

According to an aspect of the present invention, a composite strip for preparation of a substrate edge for application of labels comprises an elongated carrier web having an upper surface and a lower surface, with the lower surface having a pressure sensitive adhesive backing covered with a removable protective cover means. A high tensile strength film means is bonded directly to the upper surface of the carrier web by a further adhesive and provides a receptor surface for receiving labels. The film is of a width equal or less than the width of the carrier web and of a width sufficient to receive a label therein. This composite strip can be applied directly to a substrate edge to prepare the substrate edge for the subsequent application of labels or can already have the labels secured to the upper surface of the film prior to securement to the substrate with the labels representing the code for identification of the substrate. In addition, the composite strip may be used in combination with an extension tab member to provide an add-on tab to an existing file folder or substrate.

According to a preferred embodiment of the invention, the removable protective cover means of the composite strip is slit generally in the center of the width of the carrier web resulting in at least scoring of the carrier web to facilitate folding of the composite strip about the score in the carrier web. According to a further aspect of the invention, the removable protective cover means of the composite strip is slit to provide at least three independently removable, longitudinally extending sections which are advantageously selectively removed during application of the composite strip to a substrate.

According to a further aspect of the invention, the composite strip includes a series of discrete labels affixed onto the upper surface and within the width of the high tensile strength film to designate at least in part a particular code for the substrate edge. The labels have an outer protective transparent surface of a material having properties comparable to the high tensile strength film means and are bonded to an underlying layer of paper stock having a pressure sensitive adhesive applied to the lower surface of the paper stock. The labels and the high tensile strength film means cooperate in a manner whereby excellent adhesion is obtained between the labels and the high tensile strength film.

According to a further aspect of the invention, the composite strip includes a series of discrete labels affixed onto the upper surface and within the width of the composite strip to designate at least in part a particular code for the substrate edge. The high tensile strength film means is transparent and is applied over the labels. The labels have an outer protective transparent surface of a material having properties comparable to the high tensile strength film means and are bonded to an underlying layer of paper stock having a pressure sensitive adhesive applied to the lower surface of the paper stock.

According to a further aspect of the invention, the composite strip is made with a high tensile film having a thickness of about 0.5 mil to 1 mil and is made of the material polyethylene terephthalate.

According to yet a further aspect of the invention, an add-on tab assembly for application to a selected edge of a substrate comprising a carrier web, a high tensile strength film and a tab extension member is disclosed. The carrier web has an upper surface and a lower surface with the lower surface having a pressure sensitive adhesive with the high tensile strength film being bonded directly to the upper surface of the carrier web by a further adhesive. This high tensile strength film provides a receptor surface for receiving labels and is of a width equal to or less than the width of the carrier web and of a width to receive a label therein. The tab extension member is elongate and of a thickness comparable to the substrate to which it is to be applied. The extension member is secured to the lower surface of and intermediate the edges of the carrier web by a portion of said pressure sensitive adhesive backing. The carrier web, the tab extension member and the high tensile strength film are positioned relative to each other and are of related widths, whereby the carrier web and the high tensile strength film may be applied about a longitudinal edge of the extension member for securement thereto on both sides of said extension member in a manner to provide two extending portions of the carrier web and the high tensile strength film at the other longitudinal edge of the extension member. The carrier web further includes a removable protective cover member for the portions of the adhesive on the lower surface of the carrier web which are not secured to the extension member.

According to an aspect of the invention, the add-on tab assembly has been adapted by at least scoring the lower surface of the carrier web in the longitudinal direction of the carrier web to facilitate folding of the carrier web and the film for application to a selected edge of a substrate.

According to yet a further aspect of the invention, the add-on tab assembly is longitudinally scored on the lower surface of the carrier generally either side of the tab extension member.

According to the invention, a method of manufacturing a composite strip for preparation of a substrate edge for the application of labels is disclosed. This method comprises the steps of applying a high tensile strength film to a carrier and securing the high tensile strength film by means of an adhesive. The carrier web has an upper surface of paper stock secured to the high tensile strength film and a lower surface having a pressure sensitive adhesive covered by a release cover means. After the high tensile strength film has been secured to the carrier web, it is passed through a slitting means to cut the release cover means longitudinally with respect to the carrier and in so doing, at least scoring the lower surface of the paper stock generally centrally in the width thereof.

According to an aspect of the method of the present invention, labels are automatically applied onto the upper surface of the high tensile strength film to provide a series of discrete labels which designate at least in part a particular code.

According to yet a further aspect of the invention, a file of a file system, having an add-on tab connected to one side of the file folder edges to provide an extension for the file is disclosed. The add-on tab comprises a tab extension member of a thickness comparable to that of the file edge and having parallel spaced-apart longitudinally extending edges with one of the longitudinally extending edges of the extension member being secured adjacent the selected file edge by a carrier web means of a length approximately that of the extension member. The carrier web means is bonded to a first side of said file along the selected edge and bonded to both sides of the extension member and to the second side of the file to secure said extension member in substantial abutment with the selected file edge. A reinforcing high tensile strength film is secured directly onto the carrier web means and positioned to bridge the transition between the tab extension member and said selected file folder edge on both sides of the file folder.

According to the present invention, a method for adding a reinforced tab to a file folder edge of a file folder of a file system is also disclosed. This method comprises bonding a high tensile strength film directly onto a face of a carrier wet to reinforce the carrier web. The carrier web has a pressure sensitive adhesive backing on its other face, which is covered by a removable protective strip arrangement. The carrier web is used to secure the tab extension member, which is of a length equal to the length of the carrier web along a folder edge. The extension member is approximately the same thickness as the folder edge and the carrier web is of a width of more than twice the width of the extension member to overlap the spaced sides along the folder edge where the reinforcing film is of a sufficient width to overlap the sides and equal to or less than the width of the carrier web. In order to secure the extension member, the protective strip arrangement is removed from the carrier web and the carrier web is applied to both of the sides of the folder with the extension member secured between folded, opposing adhesive portions of the carrier web. The carrier web thus holds an edge of the extension member against the folder edge to provide on the file of a file sytem a unique, unitary tab which forms a file folder extension.

A method, according to an aspect of this invention, for adding a reinforced labelled tab to a file edge of a file system comprises applying a plurality of labels to a carrier web to designate at least in part a code peculiar to such file of the file system. The carrier web has a pressure sensitive adhesive backing covered by a removable protective strip. A transparent reinforcing film is bonded to the carrier web and over the labels to reinforce the labelled carrier web. The so-formed carrier web is used to add a tab extension member of a length equal to the length of the labelled carrier web along a file edge. The extension member is approximately the same thickness as the file edge. The carrier web is of a width more than twice the width of the extension member to overlap thereby the spaced sides along file edge. The reinforcing film is of sufficient width to overlap the sides and is equal to or less than the width of the carrier web. The protective strip is removed from the carrier web and applied to both of the film flap sides with the extension members secured between folded opposing adhesive portions of the carrier web. An edge of the extension member is held against the file edge to provide on such file of a file system a unique unitary labelled tab for the particular file.

The label arrangement, according to an aspect of this invention, for use in connecting a tab extension member adjacent the file edge comprises a carrier web of a predetermined width and length. A series of discrete visually readable labels are affixed to the carrier web to designate at least in part the code of a particular file of a file system. A continuous length of reinforcing, transparent film is bonded to the carrier web and over the labels and is equal to or less than the width of the carrier web. The carrier web is of a predetermined length approximately equal to the length of and a predetermined width greater than twice the width of a tab extension member to be connected to the file edge by the carrier web, in accordance with the method. The predetermined length of the carrier web is approximately equal to the length of selected file edge to which a tab extension member is to be connected.

A file having such labelled add-on tab according to an aspect of the invention comprises a tab extension member of a thickness comparable to that of file edge and having parallel spaced apart longitudinally extending edges. One of the extension member edges is secured adjacent the selected file edge by a folded carrier web of a length approximating that of the extension member. The carrier web is bonded to a first side of the file along the selected edge and bonded to both sides of the extension member with the carrier web extending around the free edge of the extension member and bonded to the second side of the file to secure the extension member edge adjacent the selected file edge. A series of discrete labels have been affixed to the carrier web to designate at least in part the particular code for the file and a transparent reinforcing film is bonded to the carrier web along its length and approximating its width and over the labels to reinforce the labelled carrier web to provide this unitary add-on labelled tab for the file.

BRIEF DESCRIPTION OF THE DRAWINGS

Preferred embodiments of the invention are shown in the drawings wherein:

FIG. 3 schematically illustrates the application of labels to carrier web and bonding of reinforcing film to the labelled carrier web;

FIG. 4 is a section of the carrier web showing application of labels thereto;

FIG. 5 demonstrates unrolling a labelled carrier web and severing labelled tabs from the roll;

FIG. 10 is a partial exploded perspective view of a composite strip used for preparing a substrate edge for application of labels;

FIG. 11 is a partial perspective view of the composite strip and a tab extension member;

FIG. 12 is a partial perspective view of the composite strip with a tab extension member secured to the lower surface of the strip;

FIG. 13 is a partial perspective view of the composite strip and an associated tab extension member with a series of discrete labels affixed to the top surface of the high tensile strength film;

FIG. 14 is a partial perspective view similar to FIG. 12 wherein the extension tab member has been directly secured to the lower surface of the carrier web;

DETAILED DESCRIPTION OF THE PREFERRED EMBODIMENTS

Figure 1:
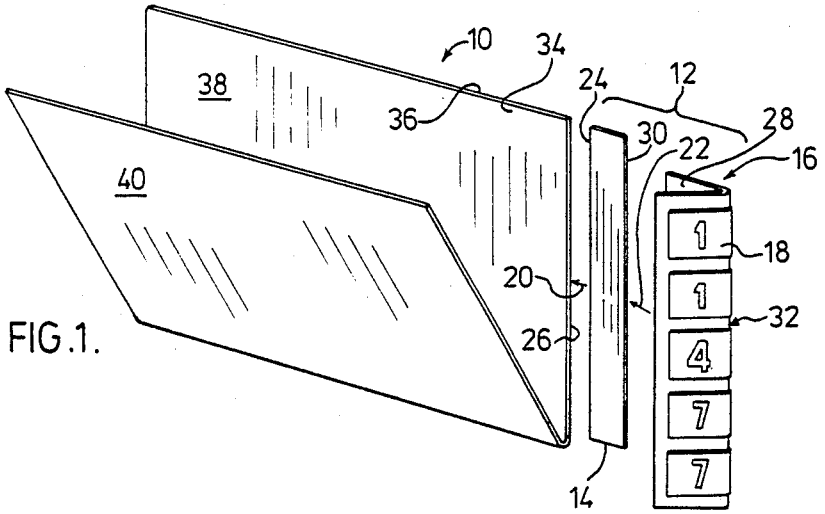
FIG. 1 is an exploded view of an add-on labelled tab for application to a file folder of a file system.

FIG. 1 shows a file 10 of a filing system. According to this embodiment, the file is in the form of a file folder having opposing flaps. Such file folders may have expandable portions at the hinge area for the flaps. Another type of file is a pocket expansion file which has expandable portions along both sides and bottoms of the pocket. The pocket expansion file may be provided with a top flap to close the pocket. In the situation shown in FIG. 1, where it is desired to provide an add-on tab on a folder flap of the file folder for reasons of wanting, for example, to convert a file system to a colour coded system or to simply facilitate coding the files, the add-on tab generally designated 12 according to this invention may be used. The tab consists of a tab extension member 14 and a carrier 16 which is folded in the manner shown and has had previously applied thereto a plurality of labels 18 which may be the same or different. Although not shown, the carrier web 16 and labels 18 are covered by a reinforcing high tensile strength film. Figuratively the application of the add on tab 12 to the folder 10 is demonstrated by the arrows 20 and 22. An edge 24 of the tab extension member is placed against or abuts a file folder edge 26. The carrier web 16 has provided on its back face 28 a pressure sensitive adhesive. The tab extension 14 is placed against the folder edge 26 where the rear edge 30 of the tab extension fits against the inside of the creased or folded area generally designated at 32 of the labelled carrier web.

The carrier web 16 is of sufficient width so as to overlap the sides 34 and 36 along the folder edge 26 such that when the carrier web 16 is affixed to the folder sides 34 and 36, the tab extension member 14 is held against the edge 26 of the folder 10. This arrangement provides a unitary extension tab member, which forms an extension for the folder flap having substantially the same structural characteristics as an integral tab extension for the same folder flap would have. When the add-on tab is bent, the connection distributes the force thereby bending the folder flap as well and avoiding hinging the add-on tab at its point of connection to folder flap edge, which would weaken the add-on tab connection and could render useless the folder with add-on tab. Preferably the tab extension member is made of a paper stock less than 1/16th of an inch in thickness and of a width about one half of an inch.

It is appreciated that the folder 10 of FIG. 1 is only representative and that other shapes and sizes of folders may be used, such as folders which are in the form of large envelopes or folders having three folder flap portions. The folder 10 as shown is of the more conventional type having flap portions 38 and 40 wherein this embodiment the add on tab 12 is added to the rear flap 38 so as to position machine readable code to be discussed hereafter, on the rear of the folder to facilitate machine reading of the code for the folder 10.

Figure 2:
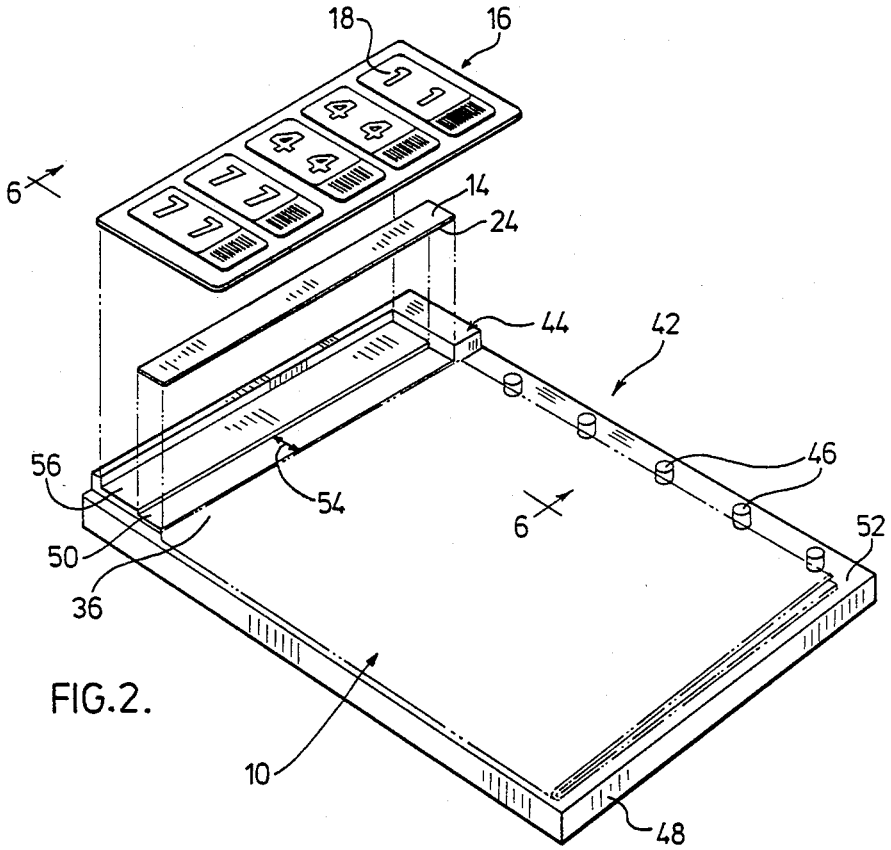
FIG. 2 is an isometric view of a template used in facilitating the application of the add-on tab to file folder.

To assist positioning the application of the add on tab to the folder 10, a template of the type shown in FIG. 2 may be used. The template generally designated 42 functions in a manner similar to that disclosed in Pfeffer, U.S. Pat. No. 4,369,582 and in Canadian Pat. No. 1,140,085 entitled "Manual Label Applying Template". The folder 10 is positioned on the template and is located relative to a label guide application device 44 by pegs 46 located on the board portion 48 of the template. The label application guide 44 includes a first step 50 which is at an elevation above the upper surface 52 of the board equal to the approximate thickness of the one file folder flaps 38 or 40 of the folder 10. Positioned in the raised portion 50, is the tab extension member 14 where its width as indicated by arrow 54 is equal to the width of the tab extension member 14 so as to place edge 24 against the folder edge 26 so presented. A second ledge 56 is provided above the first ledge 54 where it is elevated above the first ledge 50 by a thickness slightly greater than the thickness of the tab extension member 14 as will be more fully discussed with regard to FIG. 6. The ledge 56 is made of a material to which the adhesive on the back 28 of the carrier web 16 will adhere, although it may be peeled from that surface 56 once the carrier web 16 is pressed onto the side 36 of the folder 10 across the tab extension member 14 to provide an assembly such as that shown in FIG. 7.

It is appreciated, however, that other approaches may be used in applying the tab extension 12 to the folder edge 26 such as by manually folding or creasing the carrier web 16 to provide a shape such as shown in FIG. 1. Subsequently the protective cover on the back of the carrier web 16 is removed to expose the adhesive material. The tab extension member 14 is then placed into the folded carrier web so as to locate its edge 30 against the creased area 32 on the inside thereof and affix it to one side of the folded carrier web. Then, the other edge 24 of the tab extension member 14 is placed against the edge 26 of the folder and the remainder of the folded portion of the carrier web is pressed against the rear face 36 of the folder flap 38. The remainder of the carrier web is pressed across and adhered to the face of the tab extension member 14 and pressed against side 34 of folder flap 38 to complete the addition of the tab to the file folder.

In order to make one form of the labelled carrier web according to this invention, reference is made to FIGS. 3 and 4. In FIG. 3 there is schematically shown a row 58 of carrier web stock where the carrier web 16 as shown in FIG. 4 is made up of web stock 60 with a protective strip 62 to protect the pressure sensitive adhesive on the underside 28 of the web stock 60. The carrier web is unrolled from roll 58 and is moved in the direction of arrow 64 to be eventually rerolled into roll 66 which is made up of labelled carrier web having a reinforcing film bonded to the carrier web and over the labels. The roll 66 may be driven in the direction of arrow 68 so as to pull the carrier stock web 16 through a labelling machine schematically shown at 70.

In addition, it is preferrable to precut the protective strip 62 of release paper in the length thereof prior to application to the adhesive surface 28 to allow separate removal of the individual strip sections of the release paper. By precutting the release paper, as opposed to cutting of the release paper when secured to surface 28, the release paper easily separates from surface 28 for application to a folder, file or x-ray jacket, or for securement of an extension tab as shown in FIGS. 14, 18, 19 and 22. The application of the final composite strip will be further described with respect to FIGS. 11 through 14.

The labeller machine may be of the type disclosed in Barber et al, U.S. Pat. No. 4,183,779. As disclosed in this patent, the labeller is controlled so as to apply to a moving web a predetermined sequential series of labels where such series may be applied to the web in spaced apart groupings. As shown there are three different series of three labels in each group at 72, 74 and 76. It is understood that any number of labels may be applied to the carrier web for each series, such as five or seven labels per series in the manner shown in FIG. 1. Each label series is different to designate a particular code for each file of the file system to which the add-on tab is to be applied. The series of labels 72, 74 and 76 are spaced apart by the spaces 78. The labeller 70 may be programmed such that the space between each series of labels is consistent to facilitate the mechanical application of the labelled reinforced web to folders of a file system where the labelled reinforced carrier web stock is unrolled from roll 66.

To reinforce the carrier web with labels applied thereto to achieve the novel strength characteristics of the add-on tab, a reinforcing transparent film is applied to the labelled surface of the carrier web 16. This film may be of the high tensile strength type, such as, a type of film sold under the trade mark "MYLAR" by DuPont and consists of polyethylene terephthalate. Such film may also be obtained from several other sources of supply such as "Celanar" (trademark) from Celanese, "Meliex" (trademark) from ICI Americas, "Terphane" (trademark) from Rhodia, "Scotchpar" (trademark) from 3M and "Sheldahl" (trademark) from Sheldahl. Such film of substantially thinner construction than the carrier web 16 when applied to the carrier web, unexpectedly increases the strength of the carrier web such that when used in securing a tab extension to a folder edge provides a tab extension which is quite rugged and has approximately the same strength characteristics of a comparable tab extension which is integral with a file folder flap.

As shown in FIG. 4, such reinforcing film 80 is applied to the labelled surface of the carrier web portion 60. A roll 82 of such film may be payed out and pressed against the carrier web surface by an application roller 84 which effects a bonding of the film 80 to the carrier web surface and over the applied labels because the underside of the film 18 has a pressure sensitive adhesive. For purposes of demonstrating the relationship of the film to the carrier web, labels 18 are positioned on the carrier web 16.

Thus it can be seen that the carrier web 16 has applied to its surface a plurality of labels where the code of the series of labels applied may be different from the next series as determined by the programme for the labeller 70. In preparing tabs for files of a file system the codes for all the files may be programmed into the labeller such that each series 72, 74, 76 etc. of labels reflects the particular code for each file to which the respective tab is to be applied to thereby distinguish that file from all other files in the system.

The label 18 according to this embodiment has two identical indicia provided thereon such as shown in FIG. 4. There are two identical indicium namely the numeral "4" and designated 86, which are spaced apart from one another and lie in a colour field designated 88 where the colour of that field is representative of the particular indicium "4". Off to one side of the colour field 88, a machine readable code 90 is provided and as shown, the machine readable code is the well known form of "bar code". Such type of label may be the same as that disclosed in the Barber et al, U.S. Pat. No. 4,204,639 which is used to provide a colour coded group of files where the colour coded indicia code is unique to each file and, in addition, the machine readable code on each label when applied to the carrier web and subsequently secured to a file folder provides a system whereby the code for each file may be machine read to facilitate computerized file room control of the file system.

As previously mentioned the series of labels on the carrier web may be severed from the roll 68 and mechanically applied to file folders. Such an approach is attractive where a file system contains many thousands of files to be converted to, for example, a machine readable colour coded filing system. However, in other situations where there are lesser files in the system or where it is desired to simply hand or manually apply the add-on tabs, an approach is shown in FIGS. 5 through 8. As shown in FIG. 5 the roll of labelled reinforced carrier web 66 is unrolled in the direction of arrow 92 and a series 94 of labels is severed by scissors 96 from the length of carrier web. Such cut portion of carrier web may be trimmed so as to match the length of the tab extension member 14 or conversely the tab extension member 14 may be trimmed to the severed or cut length of the carrier web 16 of FIG. 2. This method, therefore, provides an add-on tab having a plurality of labels which designate at least in part the code of a particular file of the file system. The labelled tab in consisting of a labelled carrier web, permits the making of an add-on tab which presents all labels designating the file folder code on a unitary structure. This avoids the problems of prior art devices where an individual tab for each file code indicium is required resulting in the applied tabs moving one relative to the other and increasing the chances of destroying or damaging such file add-on coded tabs. As shown in FIG. 1, the length of the add-on tab is approximately equal to the length dimension of folder flap edge 26. Thus when any portion of the add-on tab is bent during handling of the folder, the bending forces are distributed along the length of folder flap edge to lessen pressure points on the add-on tab connection and reduce thereby chances of damaging the connection.

Figure 6:
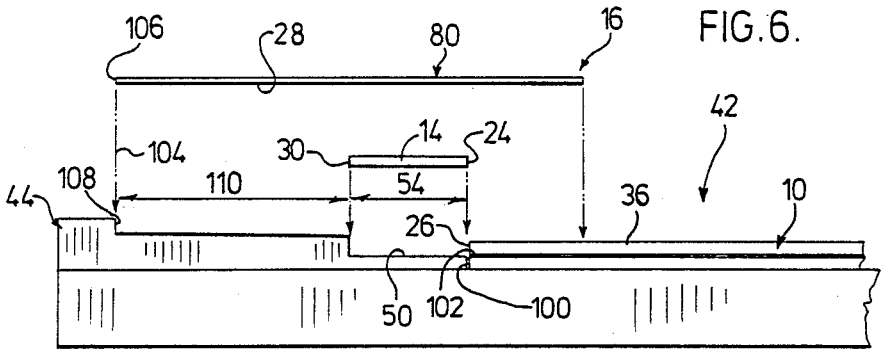
FIG. 6 is a section along the lines 6—6 of FIG. 2.

Referring to FIG. 6, the width of carrier web 16 having the labels applied thereto with the reinforcing film 80 bonded to the upper face thereof may be positioned over top of the label guide application device 44 of the template 42. With the file folder 10 positioned with its edge 26 adjacent a tab extension member 14 to be lowered on to the shelf area 50, the lower edge 100 of the folder abuts edge 102 of the label applicator guide 44 to properly position the edge of folder 10 so that when the tab extension member 14 is placed on ledge 50, its edge 24 abuts or is adjacent edge 26 of folder 10. This is determined by the width 54 of the shelf 50 which is approximately the same as the width of the tab extension member 14.

The shelf 56 is elevated above shelf 50 by a height which is slightly greater than the thickness of the tab extension member 14 to allow some tolerance to facilitate location and temporarily sticking of the carrier web 16 with its pressure sensitive adhesive backing 28 to the shelf 56. As explained in applicant's above noted pending application on this template, the shelf 56 may be formed of a material which releases the adhesive backing of the carrier web 16. Such material may be preferably "Teflon" (trademark). The sequence in adding the components of the add-on tab onto the label template 42 can be altered. For example, the folder 10 may be positioned on the template against guide pegs 46 and against edge 102 of the label guide 44 and then the tab extension member 14 positioned on shelf 50. Subsequently the carrier web 16 may be lowered in the direction of arrow 104 and pressed against face 56 where its edge 106 abuts edge 108 of the label guide so as to perfectly align the carrier web as labelled along the outer edge 30 of the extension member 14. The distance or width 110 of shelf 56 may vary depending upon the configuration for the add-on tab. According to this embodiment the width 110 is approximately one half the width of the carrier web 16. With edge 106 positioned, the carrier web is pressed onto shelf 56 and then pressed onto the back surface 36 of the folder 10 and across the tab extension member 14 to hold or locate the extension member edge 24 against edge 26 of the folder 10.

Figure 7:
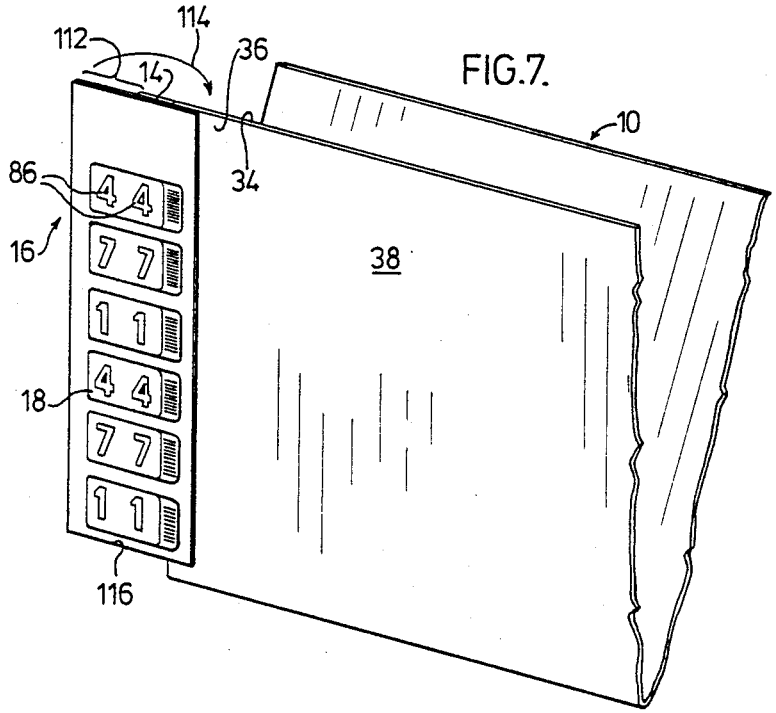
FIG. 7 shows the file folder removed from the template of FIG. 6 to demonstrate the remaining step in applying the tab to the folder.

The folder 10 may be removed from the template to provide an arrangement shown in FIG. 7 where the rear flap 38 of the folder 10 has one half of the carrier web 16 secured to rear face 36 and across face of extension member 14. The overall width of the carrier web is such to be greater than twice the width of the tab extension member 14 so as to overlap the side 36 and subsequently the inner side 34 of the flap 38 to the extent shown. This provides for a secure connection of the add-on tab to the folder edge.

Figure 8:
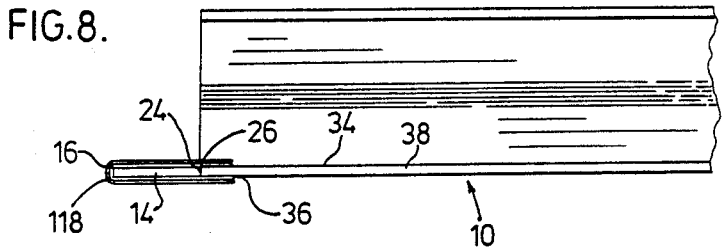
FIG. 8 is a top view of the folder with the tab added onto the folder edge.

The remainder of the carrier web as shown at 112 is moved in the direction of arrow 114 and pressed onto the remaining face of the extension member 14 and the inner side 34 of the flap 38. To complete the addition of the add-on tab to the folder as shown in FIG. 8, the folder 10 has the edge 24 of the tab extension member 14 held adjacent and in this instance abutting the edge 26 of the folder 10. The carrier web having labels thereon is applied about the edge of the tab extension to overlap and be bonded to the faces 34 and 36 of the flap 38.

It can be seen that the additional thickness added to the folder edge is that of a thickness of the carrier web and the reinforcing film. It should be emphasized that in FIG. 8 the thickness has been enlarged for purposes of illustration however the thickness of the reinforcing film may be in the range of about 0.5 mils up to 1 mil and the carrier web may be in the range of 3 mils up to 6 mils. There is little appreciable addition to the thickness of the folder edge in using such an add-on tab. However, there is a substantial increase in the rigidity of the add-on tab and added life to the add-on tab of the file folder as provide for in combination of the laminated layers for the add-on tab.

The selection of the material for the tab extension member 14 may be the same as the material in the folder flap 38 so that the tab extension member 14 is of approximately the same thickness as the folder flap 38. It is also possible to use a plastic tab extension member although the cost of the final product does increase.

The positioning of the labels 18 on the carrier web 16 is such that the colour field between the indicia 86 of each label 18 is approximately centered on the fold line for the carrier web as shown at 116. The colour field of each label of the particular file folder tab is presented along the outer edge at 118 as shown in FIG. 8 for each add-on tab so as to provide a band of colours peculiar to each file folder. When all files are placed on a shelving system, an appropriate colour coding system for the filing arrangement is provided such as disclosed in the Barber et al, U.S. Pat. No. 4,204,639.

Regarding the use of the template 42 for applying the add-on tab to the folder, it is appreciated that alternative sequences may be used in applying the carrier web 16. For example, prior to locating of the folder and tab extension member 14 on the template, the web 16 may be affixed to shelf 56 with its edge 106 abutting guide edge 108. The tab extension member 54 may then be placed under the carrier web 16 because the shelf 56 is elevated above shelf 50 by a height greater than the thickness of the extension member 14. Subsequent to this, the file folder 10 may be inserted under the carrier web 16 with its lower edge 100 abutting edge 102 of the guide. This procedure enables positioning of the carrier web 16 on the label guide without concern for touching of the adhesive backing 28 of the carrier web against either the tab extension member 14 or the back face 36 of folder flap 38 while positioning the label. This is particularly advantageous in situations where the adhesive backing 28 has a very powerful adhesive attraction to the paper of the tab extension member and folder, so that a slight touching of the adhesive backing to the folder or tab extension member during a positioning of the label on the shelf 56 would result in a spoiled label, after removing the carrier web for respositioning on the shelf 56.

Figure 9:
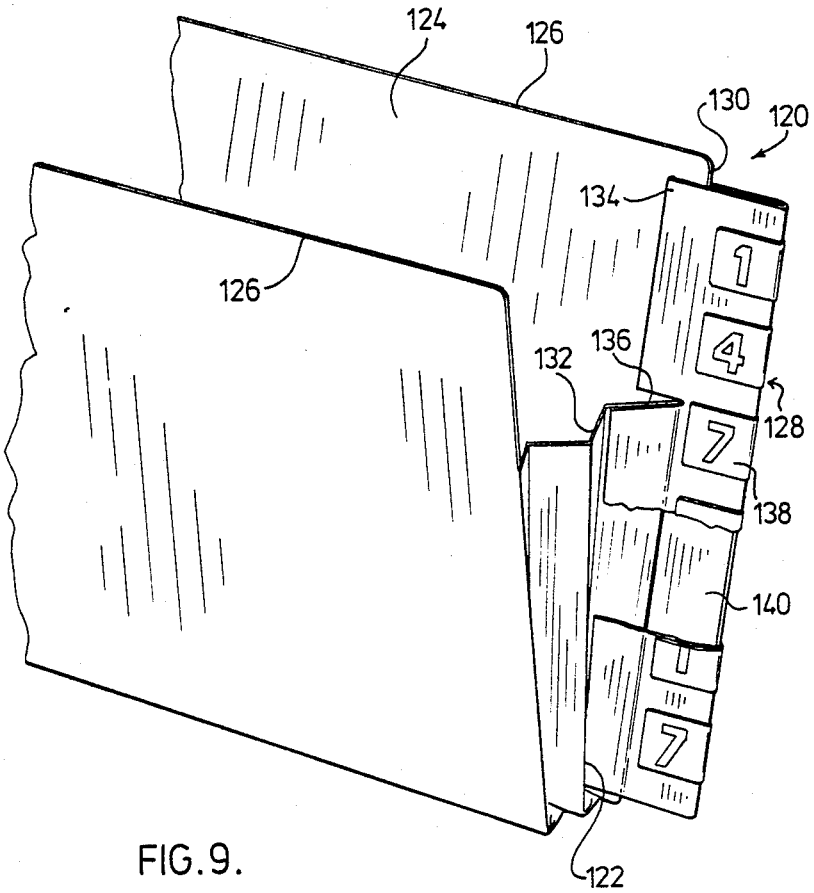
FIG. 9 is a perspective view of an end of an expansion pocket file having the add-on tab applied to an edge thereof.

Turning to FIG. 9, an expansion pocket file 120 is shown where an add-on tab according to this invention is applied thereto. The pocket file has expandable portions, such as at 122, along both sides and bottom to provide an open top 124. The expandable portions interconnect pocket opposing flaps 126. The add-on tab 128 is applied to the rear edge 130 of the file. The expandable portion 122 has a plurality of gussets 132 where the carrier web 134 of the add-on label arrangement is applied to the front and rear faces of flap 126 along edge 130. The carrier web is partially severed at 136 to permit gusset 132 adjacent edge 130 to move outwardly from flap 126 when the file is expanded.

The add-on tab is of the same construction as that shown in FIG. 1, where the colour coded labels 138 are affixed to the carrier web and covered by the reinforcing transparent "Mylar" film. As shown in the cut-away area of the label arrangement, the tab extension member 140, which is of approximately the same thickness as edge 130, is secured adjacent the edge by carrier web 134 of the add-on tab construction. The flexibility of this coded add-on tab is exemplified in its use on both file folders and pocket expansion files.

As previously mention, "Mylar" is a thin film and may be as thin as 0.5 mils. The "Mylar" film width is no greater than the width of the carrier and to facilitate application of the "Mylar" film to the carrier web, it may be slightly less than the width of the carrier web to accommodate some misalignment in application of "Mylar" film to the labelled carrier web. The method also provides for the preparation of individual unique colour coded labelled add-on tabs which are machine readable for respective folders in a coded file system by using labels of the Barber et al U.S. Pat. No. 4,204,639.

Other embodiments of the invention are illustrated in FIGS. 10 through 22. The novel composite strip of the present invention is first described and subsequently the composite strip is illustrated in combination with labels and or file extension members. In these embodiments the high tensile strength film is applied to the carrier web and provides an upper receptor surface for labels. As these products are different from those previously discussed a new numbering scheme has been used.

The composite strip of FIG. 10 is used for preparing the edge of a substrate for the application of labels. Such a strip could be used to reinforce the edge of an existing tab on a file folder and also serves to present a surface to which labels can be affixed which is more compatible with the structure of the labels. The composite strip is generally shown as 200 and includes an upper film surface 202 which is made of a material having a high tensile strength, such as that normally sold under the trademark "Mylar" which is made of a polyethylene terephthalate. It should be noted that 202 is a film and, therefore, is of a thickness generally less than 1 mil and preferably about 0.5 mil.

On the lower surface of the high tensile strength film 202 is a pressure sensitive adhesive 203 which allows the film to be directly applied to the upper surface of the carrier web 204. The lower surface of the carrier web has an adhesive 206 applied thereto to facilitate applying the strip to a substrate. A release cover paper 208 is secured beneath the pressure sensitive adhesive 206 to protect the same until it is required. The composite strip of FIG. 10 may be sold in rolls or may be sold in individual fixed length strips. The strip is easy to handle in that the carrier web gives it some structural stability thereby minimizing damage or creasing of the strip. The film by itself would be difficult to apply as creasing would be a problem. The carrier web is preferably made of a paper stock, having a thickness in the range of about 3 to 6 mils.

FIG. 11 shows additional details of the composite strip and the cover means 208 has been slit in the longitudinal direction of the carrier web to define separate release cover sections 210 through 213. Each of these sections is independent of the adjacent sections and therefore a clean cut is provided beween these sections. The depth of the cuts can be seen at the one end of the composite strip generally as 214, 216 and 218. In addition to the cover means being slit, the underlying carrier web 204 has at least been scored adjacent these locations and this facilitates bending of the composite strip about these score lines. As can be appreciated, in order to assure that the release cover sections are independent from one another they must be cut through and it is very difficult in production to accurately determine the depth of the cut. Therefore, some scoring of the under lying web 204 will result and in fact this web in some cirsumstances may be cut. However, it should be noted that the outer high tensile strength film 202 is essentially protected from any scoring or cutting by the web carrier 204.

The folding of the composite strip about these score lines is important in that it facilitates removal of the individual release sections 210 through 213 and also allows folding of the composite strip about the score line 216 for application of the strip about the edge of a file folder. As can be appreciated, this greatly simplifies the application of the composite strip to the edge of a substrate. Therefore, the lower surface of the composite strip is generally divided into the four sections 210 through 213 and the widths of sections 211 and 212 are essentially equal to the width of the extension tab member 220. Preferably sections 210 and 213 are half an inch in width and sections 211 and 212 are three quarters of an inch in width. The independently removable sections also assist in aligning the composite strip during application to a substrate and in aligning the extension during securement thereof.

Figure 16:
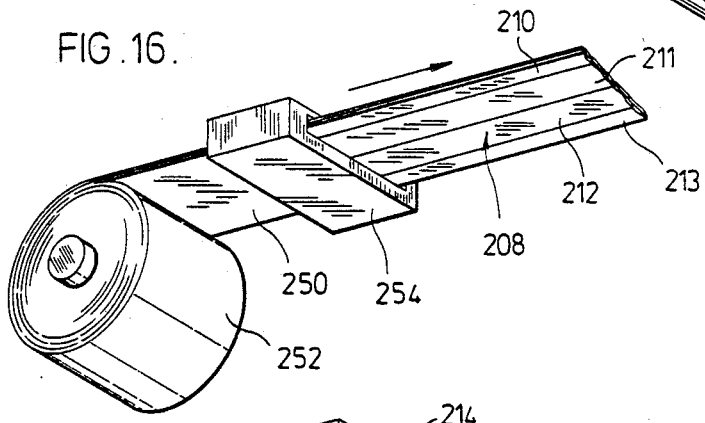
FIG. 16 is a partial perspective view illustrating a further process step performed to the lower surface of the carrier web.

It can be appreciated that the release paper 208 may be cut prior to application to the carrier web 204 as illustrated and described with respect to FIG. 4. However as described above, some advantages flow from at least scoring the carrier web at point 216 and if the release paper is precut the carrier web can also be scored if required as a separate operation before securement of the release paper. In some circumstances the cutting operation as shown in FIG. 16 causes pinching of the release paper to the underlying adhesive making removal of the paper awkward. This problem is completely overcome by the precutting of the release paper and the scoring of the paper web if needed.

In some circumstances one may wish to sell the composite strip of FIG. 11 with separate tab extension members 220. It should be also noted that the composite strip of FIG. 11 could be sold independently of an extension tab and the end user could cut his own.

As shown in FIG. 12, the composite strip can also be sold with extension member 220 directly secured to the adhesive on the lower surface of the carrier web 204. In order to secure tab extension member 220 cover section 212 has been removed and the extension tab has been pressed against the exposed adhesive of the carrier web. During application of the composite strip and tab extension to a substrate, cover section 211 will be removed to engage the exposed surface of the tab extension member 220 and cover sections 210 and 213 will be removed to engage the substrate either side thereof and secure the tab extension member adjacent a selected edge of the substrate. In order to provide positive stiffening of the tab extension member the high tensile strength film 202 is of a width to bridge the point of transition between the extension member and the selected edge of a substrate to which the assembly is to be applied. As the tab extension member is preferably about the same thickness of the substrate to which it is to be applied and the carrier web and high tensile strength film are quite thin relative to the substrate, the substrate edge is not appreciably thickened.

In addition to the three products generally shown in FIGS. 10 through 12, a series of discrete labels 224 may be applied to either of the products of FIGS. 11 and 12 and are generally shown in FIGS. 13 and 14. This series of discrete labels can also have a machine readable section 226 located to one side of the labels and each of these sections are generally aligned with respect to the longitudinal direction of the web. As can be appreciated, the scoring in the center portion of the web becomes important when machine readable codes are provided on the labels as these must align and if the fold line is not predetermined it could be offset or at an angle to the longitudinal section of the composite strip resulting in random positioning of the readable portions 226 with respect to the width of the composite strip. The individual labels 224 are applied across the width of the composite strip and are of a length less than the width of the strip. The labels are preferably colour coded as a portion of the label other than the machine readable area 226 would be coloured and may have further indica on them. Thus, the composite strip may have a series of discrete labels affixed onto the upper surface of the high tensile strength film to designate at least in part a particular code for a substrate. In the case of colour coded labels the colour would be visible along the edge of the substrate thus providing all the benefits already known with respect to colour coding of edges. It is important that the labels traverse the fold line defined by the score 16 such that they are visible along the edge of the file. While the arrangement of FIG. 14 is the preferred arrangement, it is understood the labels can be applied under the film which would be transparent.

The composition of the labels 224 are preferably an upper transparent film having properties comparable to that of the high tensile strength film 202, an intermediate paper stock having an indica printed thereon and a lower adhesive surface compatible with the high tensile strength film 202. Because the upper surface of the labels and the high tensile strength film have comparable properties the labels have been found to have superior adhesion and are not subject to separation from the composite strip.

Figure 15:
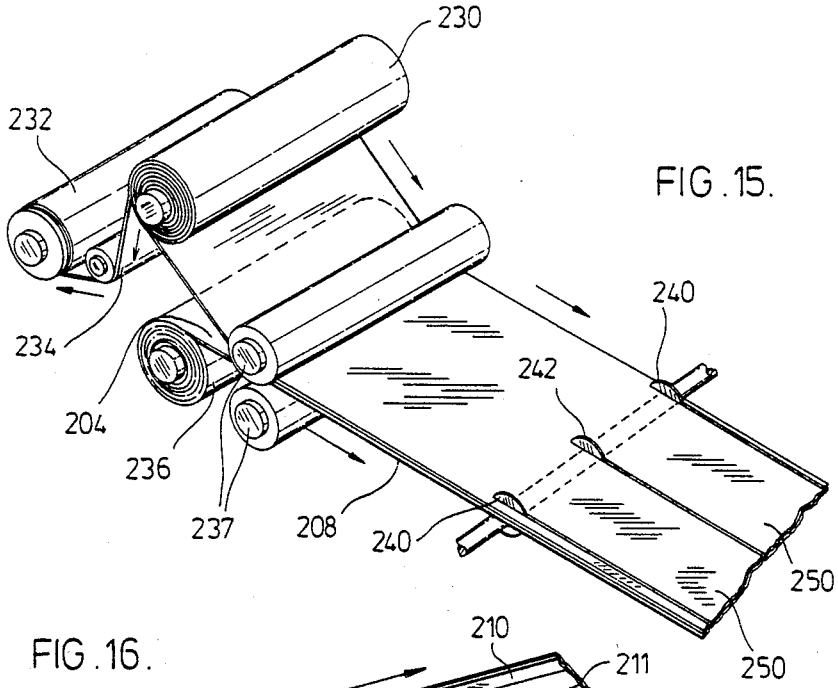
FIG. 15 is a partial perspective view of one method of manufacturing the composite strip of FIG. 10.

One method of manufacturing the composite strip of the present invention is shown in FIG. 15 where a supply of high tensile strength film 230 is being withdrawn and applied to a carrier web 204 having a supply roll 236. As the film is withdrawn from the supply 230 a release backing paper 234 is removed from the film and accumulated on roll 232. Removal of this release paper exposes an adhesive on the lower surface of the film and permits direct bonding of the film to the upper surface of the carrier web 204. Pressure is applied to the upper surface of the film and the lower surface of the carrier web by rollers 237 to assure adhesion between the film and the web. Downstream of the pressure rollers 237, a trim and cutting opereation occurs to cut the sheet material into two strips 250. These strips 250 are the composite strip generally of the structure of FIG. 10 after being trimmed by slitters 240 to precise dimensions. The center slitter 242 divides the stock in half. The strips 250 may be accumulated in a roll to provide a supply roll 252 as generally shown in FIG. 16. The elongate strip 250 may then be fed through a cutting station 254 which cuts the cover means 208 into the individual sections 210 through 213.

Figure 17:
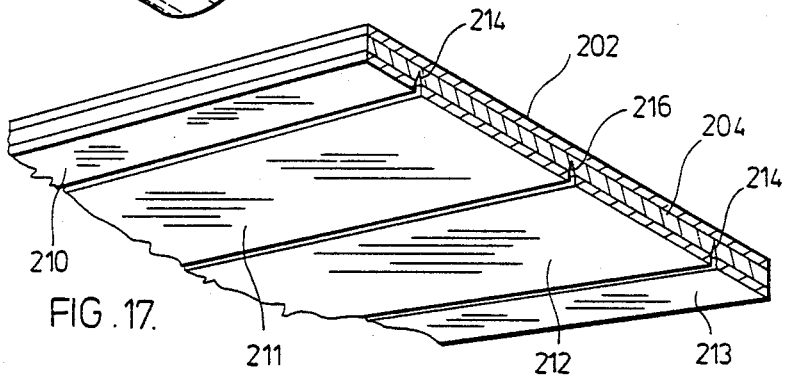
FIG. 17 is a perspective view of a portion of the composite strip wherein one of the intermediate layers of the composite strip has been scored after completion of the process steps shown in FIG. 16.

The magnified view of FIG. 17 illustrates a composite strip for the end user who wants to cut his own tab extension member. This strip has been divided into four sections which are generally directed above the cover sections 210 through 213. The center two sections 211 and 212 are generally centered with respect to the width of the carrier 204 and when the cover sections 211 and 212 are removed they are used to secure the tab extension 220 shown in the earlier figures or can be directly applied about an edge of a substrate without an extension member. The main advantage of the composite strip as shown in FIG. 12 is that it is reversible and does not have a left hand and a right hand sense. As can be appreciated, either of the sections 211 or 212 can be removed for securing an extension member and the remaining three sections may be removed to secure the tab extension member and the composite strip to a substrate edge.

Figure 18:
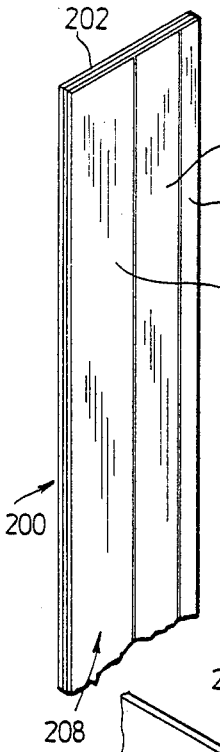
FIG. 18 is a partial perspective view of the composite strip wherein the lower surface of the strip has been slit in a manner different from that of FIG. 17.

The composite strip of FIG. 18 has only three longitudinally extending sections of the release cover means 208. These sections are identified as 215 and 217 and 219. Release section 217 may be removed thereby allowing securement of a tab assembly directly to the exposed adhesive. This section 219 is used to adhere the composite strip to one edge of the substrate and section 215 which is generally equal to the combined width of areas 217 and 219 may be removed as one piece after the composite strip and tab assembly have been secured to one side of a substrate. When section 215 is removed the composite strip may be applied about the outer edge of the extension member and wrapped around the extension member to secure the tab extension member on both sides thereof as well as secure the composite strip, both sides of the substrate.

Figure 19:
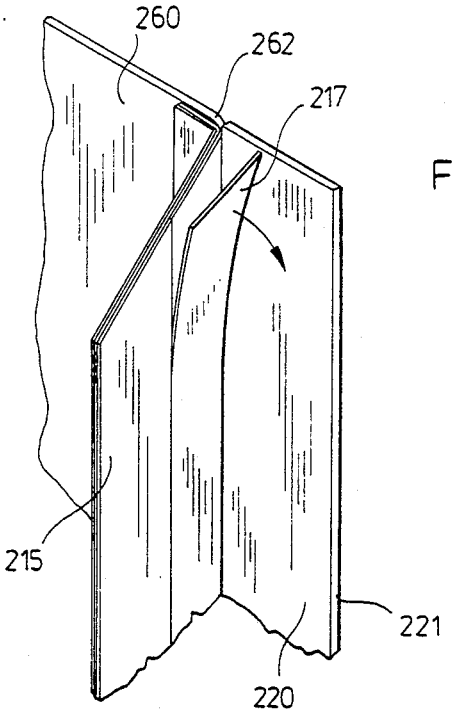
FIG. 19 is a partial perspective view showing the composite strip and an associated tab extension member being applied to the edge of a substrate.
Figure 20:
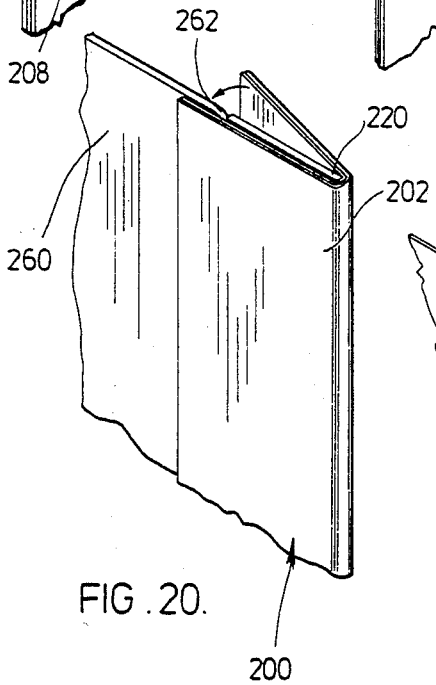
FIG. 20 is a partial perspective view similar to FIG. 19 with the composite strip being applied about the free end of the tab extension member.

Application of the composite strip to a substrate is shown in FIG. 19 and FIG. 20 where the release cover section 219 has already been removed to secure the area immediately above this to the one side of the substrate 260. The tab extension member 220 has been brought into abutting position with the selected edge 262 of the substrate and release section 217 is illustrated partially removed. After section 217 has been removed, the composite strip is secured to the tab extension member 220 and wrapped around the exterior edge 221 of the tab extension member. The release section 215 is then removed and the exposed adhesive surface applied along the opposite face of the tab extension member and the opposite facing of the substrate 260 thereby secure the tab assembly generally as shown in FIG. 20. As can be appreciated the substrate 260 has a straight edge 262 and therefore both edges of the tab extension member 220 are generally parallel.

The finished tab assembly exhibits a number of excellent properties and is not prone to tearing away from the substrate 260 or creasing of the receptor surface provided by the upper surface of the high tensile strength film 202. One possible reason for the superior properties of the resulting add-on tab assembly is the cooperation of the extension tab member 220 in abutting relationship to the substrate 260 and being maintained in this position by the composite strip 200. This composite strip serves to distribute forces exerted on the tab assembly to a larger portion of the body of the substrate 260 thereby minimizing the possibilities of tearing of the tab assembly. Furthermore creasing or folding of the tab at the junction of the tab extension member 220 and the abutting edge of the substrate 262 is minimized due to the properties of the high tensile strength film 202. This film has an excellent memory and therefore opposes any forces which would tend to cause hinging about this position.

Figure 21:
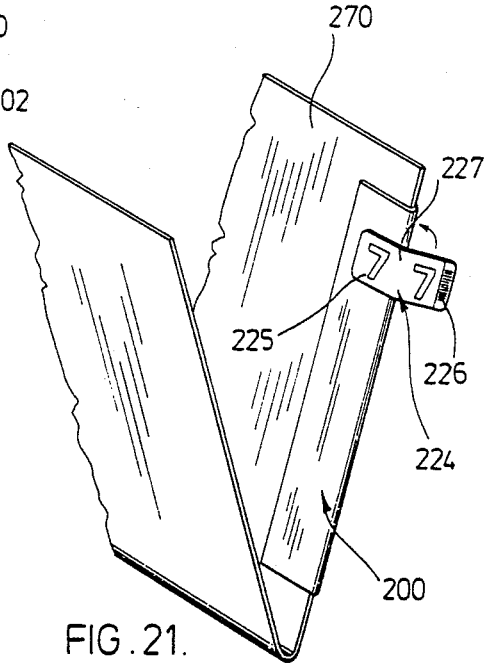
FIG. 21 is a partial perspective view showing the composite strip and an associated label being applied to the edge of a substrate.

Although the composite strip is extremely useful for the tab assembly as generally shown in FIGS. 18 through 20, it can also be applied to the edge of a substrate such as an X-ray jacket, a file backer or one edge of a file folder 270 generally as shown in FIG. 21. Once applied to the substrate 270, the strip then serves as a receptor surface for receiving the series of discrete labels. It can be appreciated these strips could include labels previously automatically applied.

Figure 22:
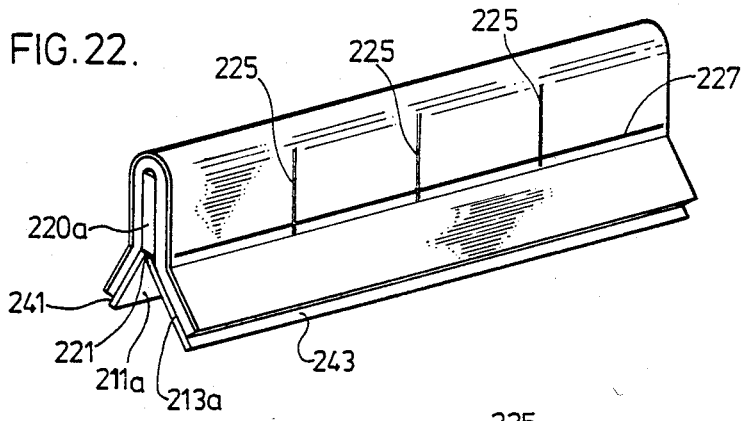
FIG. 22 is a perspective view of a modified add on tab.
Figure 23:
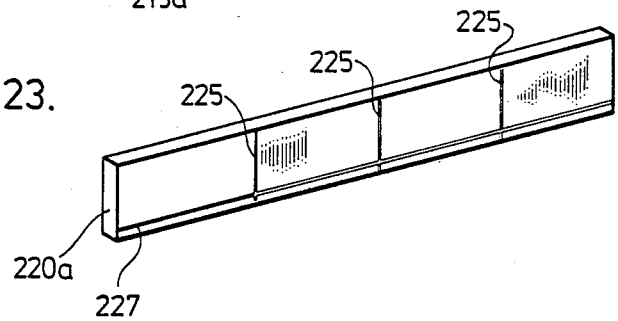
FIG. 23 is a perspective view of a premarked tab extension member.

The preferred form of the composite strip, in combination with the elongate tab extension member, is shown in FIG. 22. In this embodiment, the tab extension member **220*a* is shown with the composite strip applied thereabout in a manner to expose one edge 221 of the tab extension member for abutment with the straight edge of a substrate. Because the lower surface of the carrier web is secured either side of the tab extension member, only two strips of release paper 211*a* and 213*a* are applied to the lower surface of the carrier web either side of the tab extension member, which protect the pressure sensitive adhesive prior to securing the combination to a substrate. The release paper 211*a* and 213*a* can be oversized to provide exposed tabs 241 and 243 respectively, which facilitate removal of the release paper when required. This particular structure allows the combination to be easily applied to the edge of a substrate. It can be appreciated, any portion of the release paper extending beyond the carrier web would assist in removal of the release paper and it need not extend the entire length of the carrier web as shown. The oversized release paper can also be advantageously used in combination with any of the products shown in FIGS. 10, 11, 12, 13, 14 and 18**.

The tab extension member **220*a* has been modified as generally shown in FIG. 22 by providing guidelines 225 and 227 to assist in the manual application of labels by the end user. In most filing systems and particularly colour coded systems, the placement of labels on the file folder edge is important and the guide marks 225 and 227 are visible through the carrier web and the mylar film. Such an arrangement is particularly useful for placing the labels having a machine readable code. These guide markings are achieved by premarking the extension tabs as desired and preferrably using a white tab extension to contrast with markings 225 and 227. The markings shown are typical examples, however, other marking arrangements could be used. The product as generally shown in FIG. 22** with or without the oversized release paper and premarked tab extension member, may be packaged in groups of 100 or more for conversion of files by the purchaser. The application of the tab assembly to a file or other substrate is simplified as the tab extension may be brought into abutment with the edge of the file and secured thereto by removal of the protective covers. This operation does not require a jig and can easily be completed in the field. Furthermore, it can be appreciated the product could be sold prelabelled, preferrably automatically. In this case, premarking of the tab extension would not be required.

It has been found that the reinforcing film provides a superior surface to which labels having pressure sensitive adhesive backings are secured. The reinforcing film may be of the high tensile strenght type, such as a type of film sold under the trademark "Mylar" by DuPont which consists of polyethylene terephthalate. The film may also be obtained from several other sources of supply, such as "Celanar" (trademark) from Celanese, "Meliex" (trademark) from ICI Americas, "Terphane" (trademark) from Rhodia, "Scotchpar" (trademark) from 3M and "Sheldahl" (trademark) from Sheldahl. Such film of substantially thinner construction than the carrier web 16 when applied to the carrier web, unexpectedly increases the strength of the carrier web such that when used in securing a tab extension to a folder edge, provides a tab extension which is quite rugged and has comparable strength characteristics to a tab extension which is integral with a file folder flap. The composite strip can advantageously be used in preparing a substrate edge for the subsequent reception of labels or the labels can be previously applied underneath or to the surface of the reinforcing film. Although it is preferrable that the reinforcing film be applied about the edge of the tab extension or edge of the substrate it is not limited to this embodiment as two strips of film could be used, one either side of the substrate.

The width of the "Mylar" film is equal to that of the carrier web when prepared in accordance with the method of FIG. 15. On the other hand, if the "Mylar" film is applied to the individual carrier webs, it may be of a width slightly less than the width of the carrier web to accommodate some misalignment in the application of the "Mylar" film to the carrier web.

The essential point is that, when the extension tab is used and is abutted against the edge of the substrate, the joint between the extension tab and substrate be bridged on each side by both the carrier web and the reinforcing film bonded thereto and that such bridging carrier web with the reinforcing film bonded thereto be adhered to the extension tab and substrate over an appreciable width each side of the joint. It will be appreciated that with the substrate and extension tab of essentially the same thickness the bridging portions of the carrier web and reinforcing film stretching across the joint and maintaining the extension tab and substrate in abutment will be essentially planar and the bridging portions on opposite sides of the joint will be essentially parallel.

According to a preferred form of labelling the add-on extension tab, a color coding system may be used such as disclosed in Barber et al, U.S. Pat. No. 4,204,639. One color coded label is shown in FIG. 21, where each label 224 has a color field 227 in which an identical pair of indicia 225 is spaced apart in the color field 227. To the side of the color field is a machine readable bar code 226 which designates in machine language the indicia 225 in the color field. When all of these labels are applied to a folder edge, the color coding of each label provides the distinctive color array for that file and at the same time numerically designates the file and also provides a machine readable code along the file to designate in computer readable format the file code. This provides a file system whereby the code for each file may be machine read to facilitate computerized fileroom control of the file system. The labels 224 may be manually applied to the reinforced carrier web by simply wrapping the labels around the blank add-on tab extension. In the alternative, such labels may be machine applied to the reinforced carrier web prior to using the reinforced carrier web for connecting the tab extension member to the file folder edge. An example of a labeller machine, which may be used to automatically apply labels to the carrier web, is that disclosed in U.S. Pat. No. 4,183,779. The labeller of that patent is controlled so as to apply to a moving web a predetermined sequential series of labels, where such series may be applied to the web in spaced-apart groupings. Thus, the composite strip of FIG. 12 could be sold in rolls with the labels already applied.

As is disclosed in U.S. Pat. No. 4,183,779, the machine is programmable so that each series of labels as applied to the carrier web is different from the next series in accordance with the program to provide the unique codes for each file folder to be labelled of the file system.

The product, according to this invention, provides an add-on tab having structural properties comparable to integral tabs. The product also provides for the preparation of individual unique color coded labelled add-on tabs which are machine readable for respective folders in a coded file system by using labels such as that disclosed in U.S. Pat. No. 4,204,639. A composite strip is provided suitable for application to a substrate edge to prepare the substrate for the reception of labels. It is also possible to have the labels previously applied to the strip either on top of the reinforcing film or beneath the film.

Although various preferred embodiments of the invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. An add on tab assembly to be applied to a selected straight edge of a substrate comprising an elongate carrier web and an elongate tab extension member, said carrier web having an upper surface and a lower surface, said upper surface having a high tensile strength film means bonded directly thereto and providing a receptor surface for separate preprinted color coded labels secured thereon, said lower surface having a pressure sensitive adhesive applied thereto, said film means being of a width equal to or less than the width of said carrier web and of a width to receive a label therewithin, said elongate tab extension member having substantially straight side edges and of a width about one half of an inch, said carrier web being applied about said tab extension member in a manner to present an exposed side edge of said member for abutment with the selected substrate edge with said carrier web extending beyond said tab extension member, for securing said assembly to such substrate edge upon removal of release paper secured to the lower surface said carrier web; each of said labels including an upper transparent film having properties comparable to that of said high tensile strength film means, an intermediate paper stock layer having colored indicia printed thereon and visible through the transparent film, and a lower adhesive layer compatible with said film means and adhered thereto.

2. An add on tab assembly as claimed in claim 1 wherein said carrier web is made of a paper stock and said tab extension member includes guidelines for the placement of labels and is of a colour which in combination with a light in colour carrier web permits recognition of the guidelines through the carrier web when secured about said tab extension member.

3. An add on tab assembly as claimed in claim 2 wherein said tab extension member is of paper stock less than 1/16th of an inch in thickness.

* * * * *